United States Patent [19]

Elliott et al.

[11] 4,051,050

[45] Sept. 27, 1977

[54] OIL-SOLUBLE ANIONIC-GRAFT POLYMER OF ETHYLENE-PROPYLENE COPOLYMER AND ANIONICALLY POLYMERIZABLE MONOMER HAVING UTILITY AS MULTIFUNCTIONAL V. I. IMPROVER FOR LUBRICATING OILS

[75] Inventors: Robert L. Elliott, Scotch Plains; John Brooke Gardiner, Mountainside, both of N.J.

[73] Assignee: Exxon Research & Engineering Co., Linden, N.J.

[21] Appl. No.: 680,077

[22] Filed: Apr. 26, 1976

[51] Int. Cl.[2] ..... C10M 1/36; C10M 1/18

[52] U.S. Cl. ..... 252/51.5 R; 252/51.5 A; 252/55; 252/56 R; 252/50; 260/878 R

[58] Field of Search ..... 252/51.5 A, 51.5 R, 252/50, 56 R, 55; 260/878 R

[56] References Cited

U.S. PATENT DOCUMENTS

| | | | |
|---|---|---|---|
| 3,687,849 | 4/1972 | Abbott | 252/51.5 A |
| 3,864,268 | 2/1975 | Culbertson et al. | 252/51.5 A |
| 3,879,304 | 4/1975 | Waldbillig | 252/51.5 A |

*Primary Examiner*—Arthur P. Demers

*Attorney, Agent, or Firm*—Roland A. Dexter; Frank T. Johmann

[57] ABSTRACT

An oil-soluble anionic-graft polymer of an anionically polymerizable monomer, preferably an ethylenically unsaturated nitrogen-containing monomer, e.g. acrylonitrile, and an anion of an oxidized copolymer of ethylene and at least one $C_3$ to $C_{50}$ alpha monoolefin, e.g. propylene, said anionic-graft polymer in its preferred form containing from about 0.005 to 2% by weight nitrogen and having a number average molecular weight of from about 1000 to 500,000, has utility as a multifunctional V.I. improver or dispersant for lubricating oils.

24 Claims, No Drawings

OIL-SOLUBLE ANIONIC-GRAFT POLYMER OF ETHYLENE-PROPYLENE COPOLYMER AND ANIONICALLY POLYMERIZABLE MONOMER HAVING UTILITY AS MULTIFUNCTIONAL V. I. IMPROVER FOR LUBRICATING OILS

BACKGROUND OF THE INVENTION

1. Field of the Invention

This invention relates to anionic-graft polymers. More particularly, the invention relates to viscosity improving polymeric additives which also imrove the sludge dispersancy of oleaginous compositions and to the preparation of such additives. Broadly, the novel additives are polymers prepared by an anionic-graft polymerization of monomers containing at least one vinylidene group, or N,N(di $C_{1-10}$hydrocarboxyl carbodiimide group, onto an oxidized copolymer of ethylene and propylene which previously had been contacted with a strong base such as butyllithium.

2. Description of the Prior Art

The literature abounds with discussions of multifunctional viscosity index (V.I.) improvers usually containing nitrogen to enhance their dispersant activity, including polymeric nitrile-containing substances, as lubricating oil additives with detergent-dispersant and other properties.

The preparation of such multifunctional V.I. improving polymeric substances according to the prior art included: copolymerization of one or more olefins with a nitrile containing monomer (U.S. Pat. No. 3,445,387); free radical-grafting a hydroperoxidized ethylene copolymer with a polar vinylidene monomer, such as acrylonitrile (see U.S. Pat. No. 3,404,091); reacting a nitrile-containing compound with a reactive copolymer such as is obtained from free radical-grafting of maleic anhydride to polyisobutylene (see U.S. Pat. No. 3,448,049); free radical-grafting an ester of an aminoalcohol onto an oxidized interpolymer of ethylene and propylene (see U.S. Pat. No. 3,687,849); and, thermally reacting amines with an oxidized ethylene-propylene copolymer (see U.S. Pat. No. 3,864,268).

These processes which utilize free radicals have certain disadvantages, including irreversible crosslinking of the copolymer and homopolymerization of monomeric components. One of such disadvantages is shown by U.S. Pat. No. 3,236,917 wherein the initiation of the desired addition reaction by the generation of free radicals also provokes grafting of a single molecule of maleic anhydride into two copolymer chains thereby irreversibly crosslinking the copolymer and markedly decreasing its solubility in oil. One approach to overcoming this disadvantage is shown in U.S. Pat. No. 3,378,492 which teaches grafting an unsaturated hydrocarbon polymeric compound, e.g. polybutadiene, directly with an unsaturated, polar, nitrogen-containing organic compound, e.g. acrylonitrile, by a free radical initiated reaction.

Another approach to preparing an oil-soluble nitrogeneous ashless dispersant involves reacting an alkali metal salt of a long-chain ketone with acrylonitrile (see U.S. Pat. No. 3,565,803 and 3,723,501). Unfortunately, formation of the dialkyl ketone precursor is by ozonization which is an expensive and hazardous process involving dimethyl sulfide, an environmentally toxic agent.

Also taught as a multifunctional additive for lubricating oils is the anionic-graft polymer of a lithiated ethylene-propylene-hexadiene terpolymer with an amino methacrylate monomer (see U.S. Pat. No. 3,879,304).

STATEMENT OF THE INVENTION

It has been found that multifunctional viscosity improvwers of enhanced dispersancy can be obtained by combining the anion of an oxidized copolymer of ethylene and one or more $C_3$ to $C_{50}$, preferably $C_3$ to $C_{18}$, alpha monoolefins with a $C_3$–$C_{50}$ anionically polymerizable monomer.

This finding has, in accordance with this invention, made possible the realization of a new class of inventive products which can be characterized as the polymeric product of anion of an oxidized copolymer of ethylene and at least one $C_3$–$C_{50}$ alpha olefin monomer anionically-grafted with a monomeric compound which is polymerizable by anionic catalyst systems.

In their preferred form the products of the invention are oil-soluble, anionic-graft polymers containing from about 0.005 to 2%, preferably 0.05 to 0.8%, optimally 0.2 to 0.7%, by weight nitrogen which demonstrate outstanding dispersancy and have utility as ashless sludge dispersants.

Oleaginous, e.g. lubricating oil, compositions of this invention comprise a lubricating oil and a minor proportion of an oil-soluble anionic-graft polymer of an anionically polymerizable monomer and an oxidized copolymer of ethylene and at least one $C_3$ to $C_{50}$, preferably $C_3$ to $C_{18}$, alpha-monoolefin, said polymer containing from about 0.005 to 2%, preferably 0.005 to 0.8%, by weight nitrogen and a number average molecular weight (Mn) of from about 1000 to about 500,000 (preferably from about 1,000 to 10,000 for dispersant applications). Thus, for the former application, said anionic-graft polymer will be present in said lubricating oil in at least a dispersing amount and for the latter application in at least a V.I. improving amount. The polymers of the invention are suitable for lubricating oil applications when they possess sufficient oil-solubility, i.e. at least about 10 wt. % at 20° C. based on the total weight of the lubricating oil composition; however, when oil-soluble these polymers of the invention have application as oil-resistant rubbers in seals and gaskets for automobile automotive transmissions, thermoset resins for encapsulating electronic devices, etc. or other uses as will be apparent from the following discussion wherein it will be shown that the anionically polymerizable monomer provides a wide spectrum of functional graft-moieties to the anionic-graft polymer.

THE COPOLYMER

The term "copolymer" as used herein and in the appended claims, refers to copolymers derived from essentially ethylene and propylene; however, such copolymers may contain minor amounts, i.e. up to 20 mole percent, preferably about 1 to about 7 mole percent based on the molar amounts of the monomeric ethylene and propylene units in the copolymer, of polymerized units derived from other olefin monomers. Such other olefin monomers include olefins of the general formula $RCH = CH_2$, in which R is an aliphatic or cycloaliphatic radical of from 2 to about 48 carbon atoms, for example, 1-butene, 1-pentene, 4-methyl-1-pentene, 1-hexene, 1-heptene, 1-octene, 1-nonene, 1-decane, 4-methyl-1-nonene, 5,5-dimethyl-1-pentene; 5-methyl-1-hexene; 4-methyl-1-heptene; 5-methyl-1-heptene; 6-methyl-1-heptene, 4,4-dimethyl-1-hexene; 5,6,6-trimethyl-1-heptene, etc. Such other olefins also include monomers having a plurality of double bonds, in particular diolefins containing from about 4 to about 26 carbon atoms, e.g. 1,3-butadene, 1,4-pentadiene, 2-methyl-1, 5-hexadiene, 1,7-octadiene, etc. and preferably non-conjugated diolefins such as vinylidene norbornene, 5-methylene-2-norbornene and 1,4-hexadiene.

Suitable ethylene copolymers contain from about 2 to about 98 wt. % of ethylene and one or more $C_3$ to $C_{50}$ alpha-monoolefins, preferably propylene with a degree of crystallinity of less than 25 weight % as determined by X-ray and differential scanning calorimetry. More usually the ethylene-propylene copolymers contain from about 20 to about 20 to about 80 mole percent ethylene and from about 80, preferably from about 35 to about 65 mole percent propylene, have a number average molecular weight (Mn) of from about 1000 to about 500,000 , preferably about 10,000 to about 200,000, optimally from 20,000 to 100,000.

Methods of preparation of the copolymers are well known, including descriptions in U.S. Pat. Nos. 2,700,633; 2,726,231; 2,792,288; 2,933,480; 3,000,866; 3,063,073; 3,093,621 and literature reviews such as "Polyolefin Elastomers Based on Ethylene and Propylene", by F. P. Baldwin and G. VerStrate in Rubber Chem. & Tech. Vol. 45, No. 3, 709–881, (1972) and "Polymer Chemistry of Synthetic Elastomers," edited by Kennedy and Tornqvist, Interscience, N.Y. 1969.

In accordance with this invention, these copolymers which as indicated include terpolymers, for example, a terpolymer of ethylene, propylene and a non-conjugated diene such as 2-ethylidene-5-norbornene can be anionically polymerized according to the invention provided the terpolymer is suitably oxidized whereby sites for graft polymerization are created. Ethylene-propylene-non-conjugated diolefin terpolymers are known articles of commerce, including VISTALON®, an elastomeric copolymer of ethylene, propylene and 5-ethylidene-2-norbornene, marked by Exxon Chemical Co. New York, N.Y., and Nordel®, a copolymer of ethylene, propylene and 1,4-hexadiene, marketed by E. I. Du Pont de Nemours & Co., Wilmington, Del.

OXIDATION OF THE COPOLYMER

The oxidation can be accomplished by contacting the copolymer under suitable conditions of temperature and at atmospheric or elevated pressures, with an oxidizing agent such as air or free oxygen, or any oxygen-containing material capable of releasing oxygen under the oxidation conditions. If desired, the oxidation can be conducted in the presence of known oxidation catalysts such as platinum or a platinum group metal, and compounds containing metals such as copper, iron, cobalt, cadmium, manganese, vanadium, etc. The oxidation can be carried out by methods described in U.S. Pat. Nos. 2,982,728; 3,316,177; 3,153,025; 3,365,499; 3,544,520 and 3,864,268.

Generally, the oxidation can be carried out over a wide temperature range depending upon the activity of the agent used, for example, with air, temperatures in the range of 35°–425° C. have been used. Further, depending upon the rate desired, the oxidation can be conducted at sub-atmospheric, atmospheric or super-atmospheric pressures, and in the presence of a copolymer solvent. The conditions of temperature, pressure, oxygen content of the oxidizing agent, the rate of introducing the oxidizing agent, the catalyst employed, if any, etc., are correlated and controlled by those skilled in the art, so as to obtain the desired optimum results.

Oxidation of the copolymers and terpolymers dissolved in a solvent such as mineral oil is conveniently carried out, either in batches or continuously, in a stirred reactor with air, or air prediluted with an inert gas such as nitrogen or carbon dioxide so as to minimize explosion hazards. The air, or diluted air, may be introduced into the oil-polymer solution in a finely divided state through the use, for example, of sparger tubes fitted with porous ALUNDUM®, or fritted glass thimbles, or similar means possessing a foraminiferous like structure, at a temperature in the range of about 80° to 300° C., preferably 100° to 230° C. Rapid agitation of the reactor contents, as for example by means of a turbomixer is desirable in large batches, to ensure an optimum reaction rate and a low oxygen content in the off-gas.

In general, in the range of 0.5 to 90, e.g., 4 to 60 weight percent of the oil copolymer solution will be copolymer. Usually, about 20 to 60 weight percent of the solution will be copolymer when the polymer is of low mol. wt., e.g. with a number average molecular weight (Mn) less than 20,000. For copolymers with Mn equal to or greater than 20,000, the preferred concentrations are in the range of 4 to 20 weight percent copolymer, based on the total weight of the oil-copolymer solution.

A wide variety of mineral lubricating oils which widely range in viscosity and crude source, may be used as solvents for the polymer-oil solutions to be oxidized. The oils may be derived from Pennsylvania, Midcontinent or Coastal crudes, Middle East crudes, Venezuelan crudes, etc., and may range in viscosity from about 5 to 1000 SUS at 38° C., preferably 10 to 600 SUS at 38° C., most preferably 80 to 200 SUS at 38° C. They may be straight-run distillates in the lubricant range, e.g., boiling above 315° C., or may have been further refined by deasphalting; dewaxing; solvent extracted; treated with sorbents; or refined by hydrogenation; etc. Also suitable are synthetic hydrocarbon oils in the lubricant range made by polymerization, oligomerization, alkylation of aromatics with olefins, and the like.

Oxidation of the oil-copolymer solution is conducted for a time sufficient to impart to the solution a combined oxygen content of about 0.01 to 10.0, e.g., 0.1 to 8, preferably 0.1 to 5.0 weight percent, depending on the composition of the oil, the copolymer and the concentration of copolymer in solution.

A measure of the degree of oxidation is the specific absorption exhibited by oxygen containing group functionality about 5.8 microns in the infrared. Oxygen group functionality may conveniently be measured with an infrared spectrometer using 0.05 mm to 0.5 mm specimen thickness and sodium chloride cells. The oxygen group absorption in the useful range of oxidized solutions will usually be in the range of about 0.05 to 5.0 microns (based on a 0.5 mm cell) and depending on the oil, polymer and polymer concentration. Usually, the lower absorption values can be directly measured in a 0.5 mm cell, while higher absorption values are best measured in thinner cells, e.g., 0.1 mm or 0.2 mm cells and the values may be extrapolated to a 0.5 mm cell, if desired for comparison purposes, as was done in some of the following examples. As used herein, such terms as "oxidized", or "oxidized oil copolymer solution" etc. indicates that air or oxygen containing gas is used for the oxidation, and precludes the use of other oxidative reagents such as ozone.

Alternatively the copolymer can be oxidized in the absence of a solvent as by oxidative degradation of the copolymer. This oxidation approach is well known in the art (see French published application No. 75.23806) whereby oxygen is incorporated into the copolymer by an air-mastication procedure. This procedure may be done with a single piece of equipment or in stages. Useful equipment includes Banbury mixers and mills wherein the copolymer is readily exposed to air, which devices may be enclosed in jacketed containers through which a heating medium may be passed such as superatmospheric steam, or heated DOWTHERM®. When oxidation resulting from the air-mastication has reached a desired level i.e. at least about 0.005 wt. % oxygen as determined by oxygen uptake in said copolymer, mineral oil may be added to provide a concentration of the oxidized copolymer in the range of about 5 weight percent to 50 weight percent based on the weight of the total resulting solution. The resulting oil solution may thereafter be reacted with an alkyllithium compound to yield an anionic solution of the resultant copolymer.

Where oxidation is provided by this air-mastication process the copolymer is preferably limited to ethylene and one or more alpha-monoolefins having from 3 to 50 carbons and preferably propylene to avoid deleterious cross-linking during oxidation.

ANIONICALLY POLYMERIZABLE MONOMERS

Broadly, the anionically polymerizable monomers contemplated by the present invention generally consist of carbon, hydrogen and a heteroatom (to provide functionality) such as nitrogen (preferred herein), oxygen, sulfur, boron, phosphorous, silicon, lithium, etc. Thus, it is to be understood that the anionically polymerizable monomers may contain substituent groups such as ketone, hydroxyl, ether, mercapto, sulfide, sulfoxide, sulfonyl, etc. Generally, these monomers will contain about 3 to 50 carbon atoms and must contain at least one electron withdrawing group in such proximity to the unsaturation that the olefinic bond is thereby activated allowing polymerization with the anionic copolymer.

Thus in its broadest form, the anionically polymerizable monomer containing at least one vinylidene group may be represented by the general formula

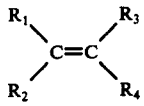

wherein $R_1$, $R_2$ and $R_3$ may be the same or individually different and are independently selected from the class consisting of hydrogen and $R_4$ is selected from the class consisting of $C_1$ to $C_{30}$ straight and branched chain alkyl, arylalkyl, cycloalkyl, alkenyl, arylalkenyl and cycloalkenyl moieties and/or one or more reactive groups of the class consisting of alkyl unsaturation, carboxyl, epoxide, thiol, carbonyl, isocyanate, thionyl, amido, imino, acylhalide, halo, thiolic anhydride, thionic anhydride, dithionic anhydride, disubstituted amino, trisubstituted amino, ureido, isourea and dicarboxylamic acid anhydride or one-half of cyclic dicarboxylic acid anhydrides as in maleic anhydride or one-half of cyclic thiolic anhydride or one-half of cyclic thionic anhydride or one-half of cyclic dithionic anhydride or one-half of cyclic dicarboxylic amic acid anhydride or one-half of cyclic N $C_{1-8}$ hydrocarbyl imides such as N-dodecylmaleimide. Non-limiting examples include: alpha-chloroacrylonitrile; 2-chloroethyl acrylate; N,N-dibutyl acrylamide; acrylamide; N-t-octyl acrylamide; thioacrylamide; N-n-dodecyl-acrylamide; N-acryloyl-morpholine; thionacrylic acid; ammonium acrylate; acrolein; ethyl vinyl ketone; 1-chloro-butenyl-ethyl ketone; vinyl chloride; 4,4,4-trichlorobutene-1; p-chloroallylbenzene; p-(chloromethyl)-styrene; 4-chloro-1-vinyl naphthalene; vinylidene chloride; 1-chloro-1-benzyl ethylene; alpha-ethyl-m(tri-chloromethyl)-styrene; methyl crotonate; allyl benzene; methyl isopropenyl ketone; maleic anhydride; fumaryl chloride maleimide. N-octyl maleimide; Other monomers are N,N-diisopropylcarbodiimide; N,N-dimethylcarbodiimide; and N,N'-methylethylcarbodiimide (the latter three compounds being representative of a highly useful and preferred class of N,N(di $C_{1-10}$ hydrocarbyl) carbodiimides.

A preferred class of nitrogen-containing anionically polymerizable monomers, to which the present invention is directed have the formula

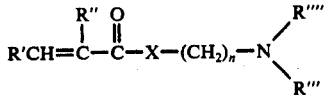

wherein X is oxygen or an NR'' group, $n$ is a whole number from 2 to 5, R' and R'' may be the same or different and are individually selected from the class consisting of hydrogen and a $C_1$ to $C_4$ alkyl group, R''' and R'''' are each $C_1$ to $C_{12}$, preferably $C_1$ to $C_4$, hydrocarbyl groups, e.g. alkyl groups. The various R groups may be the same or different. Amino methacrylates such as dialkylaminoethylmethacrylates are particularly useful.

Specific examples of compounds encompassed within the preferred class of nitrogen-containing anionically polymerizable monomers include dimethylaminoethyl methacrylate, diethylaminopropyl methacrylamide, di(isobutyl)aminoethyl methacrylate, methylisobutylaminopropyl acrylate, 4-vinyl pyridine, ethylene imine, N-vinyl pyrrolidone, carbodiimide, etc. Mixtures of various nitrogen-containing monomers may be reacted as well as the individual monomers with the oxidized ethylene copolymers.

The most preferred nitrogen-containing monomers, i.e., the unsaturated, polar, anionically polymerizable nitrile monomers to which the present invention is particularly directed above have the formula:

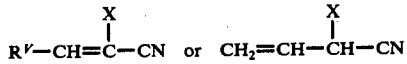

wherein $R^V$ is a hydrogen atom or a lower alkyl, e.g., methyl, ethyl and the like, X is a hydrogen atom, a halogen atom, a cyano or a lower alkyl group, e.g. methyl, ethyl, propyl, butyl and the like. Non-limiting examples of nitrile monomers which are contemplated by the aforedescribed structure include, acrylonitrile, methacyclonitrile, alpha-bromoacrylonitrile, alpha-chloroacrylonitrile, vinylidene cyanide, allyl cyanide and the like.

PREPARATION OF THE ANIONIC-GRAFT POLYMER

Usually the reaction is carried out in an inert solvent. These solvents may be polar or non-polar. Illustrative hydrocarbon solvents include benzene, toluene, cumene and preferably hydrocarbons of from 6 to 10 carbon atoms such as hexane, cyclohexane and heptane. Other solvents include ethers, both aliphatic and aromatic such as diethyl ether, and dimethyl ether with tetrehydrofuran being preferred. Individual solvents or mixtures may be used. A highly useful solvent is mineral oil or mixtures thereof in which the anionic oxidized copolymer is generally prepared.

The anionically polymerizable comonomer may be added either batchwise or incrementally to the oxidized ethylene-propylene anion solution. Preferably, the acrylonitrile is added incrementally with vigorous stirring so as to obtain relatively homogeneous diffusion of the anionically polymerizable monomer into the reaction mixture.

The preparation of the functionalized polymer from the oxidized copolymer is theorized to occur by abstraction of the acidic proton located alpha to a carbonyl structure present in the oxidized polymer. Oxidation of the ethylene copolymer is believed to introduce a multiplicity of complex carbonyl structures such as keto-, aldo-, acido- into the backbone of the polymeric molecules. Preparation of the anion of the oxidized copolymer does not measurably alter these carbonyl structures; however, strong bases such as butyllithium appear from infrared analysis (under certain circumstances) to act as a Grignard reagent and reduce said carbonyl moiety; e.g. to a hydroxy moiety. The anionically polymerizable monomer is then grafted under mild conditions onto said anionic copolymer backbone to form the anionic-graft polymer of the invention. From this it is seen that the preparation of said anionic-graft polymer is a two-stage reaction.

The first stage of the reaction comprises contacting said substantially linear oxidized copolymer in a solvent with an alkyllithium compound of from 3 to 10 carbons. The first stage contacting is conducted under anhydrous conditions (less than 0.01 wt. % water) and under an inert atmosphere, e.g., nitrogen and at a temperature between about 20° and 100° C., normally for a period of between 1 and 25 hours. The first stage contacting employs between about 1.0 and 200 millimoles alkyllithium/100 g. of said oxidized copolymer. The requisite amount of catalyst is determined by the amount of carbonyl functionality of said oxidized copolymer.

In the second stage of the reaction, the anion of said oxidized ethylene copolymer is contacted with the anionically polymerizable monomer to yield said anionic-graft polymer. Before terminating the second stage as by the addition of relatively small amounts of a proton-releasing solvent such as methanol, the anion can be contacted with an electrophillic terminating compound such as an aldimene or ketimine in order to add one or more polar groups to said polymer. The polar groups may be added in an amount ranging from about 0.01–10 wt. % based on the total weight of said polymer.

The aldimine or ketimine are formed by the known reactions of an aliphatic or aromatic aldehyde or ketone, respectively, with an amine. A non-limiting number of suitable aldehydes and ketones would be acetaldehyde, propionaldehyde, butyraldehyde, acetone, methyl ethylketone, etc. Useful amine compounds include amines of about 6 to 60, preferably 0 to 20, total carbon atoms and about 1 to 12, preferably 1 to 6, nitrogen atoms in the molecule, which amines may be hydrocarbyl amines or may include other groups such as hydroxy groups, alkoxy groups or amide groups. Preferred amines are aliphatic amines, including those of the general formula:

$$R_a-\underset{\underset{R_b}{|}}{N}-R_c \quad \text{and} \quad R_a-\underset{\underset{R_b}{|}}{N}-(CH_2)_s-[\underset{\underset{H}{|}}{N}-(CH_2]_x-\underset{\underset{R_b}{|}}{N}-R_c$$

where $R_a$, $R_b$ and $R_c$ are independently selected from the group consisting of hydrogen; $C_1$ to $C_{12}$ alkoxy $C_2$ to $C_6$ alkylene radicals, $s$ is a number from 2 to 6, preferably 2 to 4, $x$ and $t$ are independently 0 to 10, preferably 2 to 6. Examples of suitable amines include: ammonia, methyl amine and polyamines such as, ethylene diamine, diethylene triamine, triethylene tetramine, tetraethylene pentamine, etc. Another suitable class of compounds would be amines containing aldehydes or ketones. Examples of suitable compounds include urea, ethyl carbamate, N,N-dimethylcarbamoyl chloride, etc.

Another suitable class of terminating compounds would be acid chlorides and the like, which electrophilically quench the copolymer anion and thus introduce additional reactive sites. A non-limiting number of suitable examples would be acetyl chloride, methyl chloroformate, $CO_2$, etc. The resultant terminated anionic-grafted polymers can be further reacted with amines such as those earlier described for preparation of aldimines and ketimines. Specific examples of preferred amines include polyamines such as diethylenetriamine, tetraethylene pentamine, etc.

Other terminating compounds are maleic anhydride and tetracyanoethylene where cross-linking of said anionic-graft polymer may be desired.

The polymerization of the anionic copolymer and the monomer is carried out generally in the range of between about 0° and about 100° C. with agitation at atmospheric pressure or under superatmospheric pressure up to as high as 2000 psi. The time of reaction varies between about 0.2 and about 15 hours, preferably between about 0.5 and about 5 hours.

The polymerization catalyst is any strong organic base or aqueous base which will form the anion. The counterion will be preferably an alkali metal such as lithium, sodium or potassium. A number of illustrative nonlimiting examples include sodium naphthylide, potassium amide, sodium crown etherates, etc. Suitable organolithium catalysts may be represented by the formula RLi wherein R is a $C_2$ to $C_{20}$ alkyl, aralkyl, or cycloalkyl group. Specific examples of suitable catalysts include n-propyllithium, isopropyllithium, n-butyllithium, tertiary butyllithium, etc. with n-butyllithium being preferred. Strong organic bases (e.g. triethylamine) and aqueous bases (e.g. sodium hydroxide, potassium hydroxide, calcium hydroxide, barium hydroxide and the like) and alkoxides (e.g. sodium ethoxide) are also useful.

The proportions in which the above-described nitrogen-containing monomers are to be used may range widely according to the ability of said oxidized copolymer and said nitrogen-containing monomer to react with each other, but normally should range from about 0.1 to 400 preferably about 10 to about 200 parts by weight of said monomer to 100 parts by weight of said oxidized copolymer (said oxidized copolymer containing from about 0.005 to 6 wt. %, preferably 0.01 to 3 wt. %, oxygen).

It is generally desired to form oil-soluble anionic-graft polymers containing about 0.005 to 2%, and preferably about 0.05 to 0.8% by weight nitrogen (all of said % by weight nitrogen values in this specification are determined by the Kjeldahl method). Polymers containing such quantities of nitrogen have sufficient dispersancy sites to impart multifunctionality to said copolymers whereby addition of said polymers enhances the lubricating performance of lubricating oils.

The anionic-graft polymers of the invention broadly will contain from 0.005% to about 10% by weight nitrogen. As the nitrogen content increases above about 0.8 wt. %, the polymer becomes increasingly less soluble in hydrocarbons such as mineral oil whereby its utility as a hydrocarbon resistant material is increased.

POST REACTIONS OF FUNCTIONALIZED POLYMERS

These anionic-graft polymers may also be used as intermediates for polymers tailored to provide functional groups requisite to a given application. For example, the nitriles can be readily hydrolyzed into carboxylic acid derivatives which could be further reacted with amines to provide enhanced lube oil dispersancy as by employing either an alkali metal base, an alkaline earth metal base or a mineral acid, all according to conventional procedures well known in the art. Suitable bases and acids include sodium hydroxide, potassium hydroxide, calcium hydroxide, barium hydroxide, sulfuric acid, nitric acid and the like. The reaction conditions involved in the conversion of such polar groups to the corresponding carboxylate groups such as acids, amides, esters, etc. are well known to those skilled in the art and need not be detailed herein.

The corresponding carboxyl containing anionic-graft polymers either in their original solution or after isolation and re-dissolving in suitable hydrocarbon solvents of the type mentioned, can be contacted with approximately equimolar amounts of nucleophilic reagents such as said amines to convert the carboxyl derivatives into the new nucleophilic derivatives.

Non-limiting examples of suitable functional nucleophilic reagents are; water, $C_1$ to $C_{13}$ alcohols, $C_1$ to $C_{18}$ preferably $C_2$ to $C_{12}$ monobasic acids, $C_1$ to $C_{18}$ amines, $C_2$ to $C_{18}$ amides, phenol, thiophenol, alkyl phenols or thiophenol with 1 to 4 alkyl groups of 1 to 12 carbons each, $C_1$ to $C_{18}$ alkyl mercaptans, dialkylaminophenol, N,N-dialkylaminoarylene diamines, alkyl imidazolines, aryl ether alcohols, alkyl ether alkylene amines and the like.

The nitrile grafted polymer can also be converted to the corresponding imine or amine or mixtures of both through reductive procedures well known to one skilled in the art, e.g. through the use of Grignard reagents. Also the nitrile provides a site for further reactions such as chlorination, bromination, alkylation, or the like. Once halogenated, this position may be reacted with various nucleophiles as described above to produce a new type of functionality. For example, the halogen may be displaced with an amine to provide additional functionality.

ANIONIC-GRAFT POLYMER APPLICATIONS

Generally, the number average molecular weights of the anionic-graft polymer of the present invention, employed as lubricant additives, will be in the range of about 1000 to about 500,000 and preferably will be in the range of about 10,000 to 200,000. However, it will be understood that higher or lower molecular weight products may be prepared in accordance with the present invention, if desired. All molecular weight values set forth in this specification are number average molecular weights (Mn) as determined by vapor phase osmometry (VPO) and membrane osmometry.

When the functionalized polymers are employed in lubricating oils, they are preferably added in proportions of about 0.01 to about 20.0% or more, preferably about 0.1 to 10.0%, and more preferably about 0.5 to 5.0 percent by weight. The proportions giving the best results will vary somewhat according to the nature of the polymer additive, the nature of the lubricating oil base stock to which it is added and the specific purpose which the lubricant is to serve in a given case. For commercial purposes, it is convenient to prepare concentrated oil solutions in which the amount of the polymer in the composition ranges from 20 to about 80% by weight, and to transport and store then in such form. In preparing a lubricating oil composition for use as a crankcase lubricant the polymeric concentrate is merely blended with the base oil in the required amount.

The products of the present invention may be employed not only in ordinary hydrocarbon lubricating oils but also in the "heavy duty" type of lubricating oils which have been compounded with such detergent type additives as metal soaps, metal phenates, metal alcoholates, thiophosphates, amines and amine derivatives, reaction products of metal phenates and sulfur, reaction products of metal phenates and phosphorous sulfides, metal phenol sulfonates and the like. The anionic-graft polymeric additives of the present invention may be used in lubricating oils containing other additives such as barium nonyl phenol sulfide, nickel oleate, barium octadecylate, calcium phenol stearate, zinc diisopropyl salicylate, aluminum naphthenate, zinc methylcyclohexyl thiophosphate, etc.

The lubricating oil base stocks used in the compositions of this invention may be straight mineral lubricating oils or distillates derived from paraffinic, naphthenic, asphaltic, or mixed base crudes, of, if desired, various blended oils may be employed as well as residuals, particularly those from which asphaltic constituents have been carefully removed. Hydrogenated oils, white oils, or shale oil may be employed as well as synthetic oils prepared, for example, by the polymerization of olefins or by the reaction of oxides of carbon with hydrogen or by the hydrogenation of coal or its products.

For best results the base stock chosen should normally be that of an oil which (without the new polymer additive present) gives the optimum performance in the service contemplated, e.g. lubricating oils for normal applications have a viscosity which usually ranges from about 40 to 150 seconds Saybolt viscosity at 99° C. but for the lubrication of certain low and medium speed diesel engines the lubricating oil base stock is prepared from naphthenic or aromatic crudes and has a Saybolt viscosity at 99° C. of 45 to 90 seconds and for gasoline engine service, oils of higher viscosity index are often preferred, for example, up to 75 to 100, or even higher, viscosity index.

The invention will be further understood by reference to the following examples which include preferred embodiments.

EXAMPLE 1

To a stirring solution of 10 grams of oxidized (air-masticated) ethylene-propylene copolymer (44 wt. % [about 54 mole %] ethylene and 56 wt. % propylene) of 34,000 (Mn) in dry tetrahydrofuran (250 ml) maintained at ambient temperature and under a nitrogen atmosphere was rapidly added (ca. 10 sec) one ml. of a 1.6 Molar solution of n-butyllithium in hexane. The mixture was allowed to stir under the same conditions for 5 minutes after which time it was treated with 0.8 grams (15 millimoles) of acrylonitrile. The solution was slowly heated to 50° C. with agitation and additional stirring continued for 1.5 hours. The reaction was terminated with 2 ml. of methanol, and the anionic-graft polymer was isolated by precipitation with methanol (1.5 liters) containing 0.1 percent by weight 2,6-di-tert-butylmethyl-phenol.

The resulting polymer was dried in a vacuum oven at 100° C. for 15 hours, after which 9.75 g. of a yellowish orange colored polymer was recovered (yield of 90.3%). Infrared spectra shows a band at 2220 cm−1 and at 2260 $cm^{-1}$ indicative of nitrile moieties grafted onto said copolymeric backbone. The anionic-graft polymer contained 0.35 wt. % nitrogen (as determined by Kjeldahl method).

EXAMPLE 2

The procedure of Example 1 was followed except for a 0.5 hour delay in introducing acrylonitrile [0.4 g. (7.5 mmole)] and reducing the temperature from 50° C. to 40° C. 9.87 g. of the anionic-graft polymer of yellowish-orange color was recovered (yield of 95%). Infrared spectra shows bands at 2220 $cm^{-1}$ and 2260 $cm^{-1}$. The polymer contained 0.43 wt.% nitrogen (Kjeldahl).

EXAMPLE 3

The procedure of Example 2 was followed except for a 1 hour delay in introducing acrylonitrile and changed to 0.68 g. (11.3 mmole) and added as a solution in 10 ml. of tetrahydrofuran. 9.95 grams (94% of theoretical) of clear yellowish-orange colored polymer was recovered which contained 0.28 wt. % nitrogen (Kjeldahl).

EXAMPLE 4

To a stirring solution of 30 grams of air-oxidized ethylene-propylene oil concentrate (said concentrate containing 35 wt. % copolymer [having a (Mn) of about 5,000 and containing about 44 wt. % ethylene] dissolved in S100N oil) and 200 ml of dry tetrahydrofuran maintained at ambient temperature and under a nitrogen atmosphere was rapidly added (ca. 10 sec.) a commercial solution (1.6 Molar) of n-butyllithium in hexane (3 ml). The mixture was slowly heated to 50° C. with stirring (bubbles were evolved) then stirred for 2.5 hrs. while returning to room temperature. The dark solution was then treated with a solution of acrylonitrile (2 g, 30 mmole) in dry tetrahydrofuran (15 ml). The solution was slowly heated to 50° C. with agitation and additional stirring continued for 1.5 hours.

The resulting solution was transferred to a beaker and concentrated in a steam bath to yield 26.5 grams of polymer concentrate (yield of 82.8%). Infrared spectra shows a band at 2260 $cm^{-1}$ and a substantial loss of the band at 1720 $cm^{-1}$. The nitrogen level of the resulting dialyzed polymer was 0.64 wt. % (Kjeldahl) and combustion analysis of said dialyzed polymer gave 83.84 wt. % carbon, 13.94 wt. % hydrogen and 1.58 wt. % oxygen (all wt. % based on total wt. of sample).

EXAMPLE 5

The process of Example 4 was repeated except that said stirring was continued for 2.5 hours. The resulting yield was a polymer concentrate weighing 25.7 g (yield of 80.3%). The dialyzed polymer upon analysis gave 0.64 wt. % nitrogen (Kjeldahl), 84.10% carbon, 13.87 wt. % hydrogen and 1.39 wt. % oxygen.

EXAMPLE 6

To a stirring solution of 10 grams of oxidized (air-masticated) ethylene-propylene copolymer (44 wt. % ethylene and Mn of 23,000 by membrane osmometry) in dry tetrahydrofuran (250 ml) maintained at ambient temperatures and under a nitrogen atmosphere was rapidly added (ca. 10 sec.) a commercial solution 1.6 Molar of n-butyllithium in hexane (2 ml). The mixture was heated to ca. 50° C. and stirred for about 2.5 hours after which it was cooled to ambient temperature. To the mixture was then added a solution of 2.8 grams (23 mmoles) of N,N-diisopropylcarbodiimide in dry THF and mixture slowly heated to 50° C. with agitation allowed to cool to ambient temperature and then stirred for about 18 hours. The polymer was isolated by precipitation with a large volume of methanol (2 l) and then washed with an additional 100 ml of methanol. The resulting polymer was dried in a vacuum oven at about 100° C. for 15 hours after which 9.25 g of polymer was recovered. The polymer contained 0.16 wt. % nitrogen (Kjeldahl).

EXAMPLE 7

The procedure of Example 1 was followed except that the acrylonitrile was replaced by 1.2 grams of N,N-dimethylaminoethyl methacrylate. A polymer containing 0.039 wt. % nitrogen (Kjeldahl) was obtained.

EXAMPLE 8

In this example the efficacy of the anionic-graft polymers of this invention, particularly with regard to their unusual dispersancy properties in lubricating oil applications, is illustrated by comparison with a commercially available multifunctional V.I. improver, sold as Lz3702 by Lubrizol Corporation of Cleveland, Ohio, in a Sludge Inhibition Bench Test (hereinafter designated SIB). The SIB test has been found, after a large number of evaluations, to be an excellent test for assessing the dispersing power of lubricating oil dispersant additives.

The medium chosen for the SIB test was a used crankcase mineral lubricating oil composition having an original viscosity of about 325 SUS at 38° C. that had been used in a taxicab that was driven generally for short trips only, thereby causing a buildup of a high concentration of sludge precursors. The oil that was used contained by only a refined base mineral lubricating oil, a viscosity index improver, a pour point depressant and zinc dialkyldithiophosphate antiwear additive. The oil contained no sludge dispersant. A quantity of such used oil was acquired by draining and refilling the taxicab crankcase at 1000–2000 mile intervals.

The Sludge Inhibition Bench Test is conducted in the following manner: The aforesaid used crankcase oil, which is milky brown in color, is freed of sludge by centrifuging for 1 hour at about 39,000 gravities (gs.). The resulting clear bright red supernatant oil is then decanted from the insoluble sludge particles thereby separated out. However, the supernatant oil still contains oil-soluble sludge precursors which on heating under the conditions employed by this test will tend to form additional oil-insoluble deposits of sludge. The sludge inhibiting properties of the additives being tested are determined by adding to portions of the supernatant used oil, a small amount, such as 0.5, 1 or 2 weight percent, on an active ingredient basis, of the particular additive being tested. Ten grams of each blend being tested is placed in a stainless steel centrifuge tube and is heated at 138° C. for 16 hours in the presence of air. Following the heating, the tube containing the oil being tested is placed in a stainless steel centrifuge tube and is heated at 138° C. for 16 hours in the presence of air. Following the heating, the tube containing the oil being tested is cooled and then centrifuged for 30 minutes at about 39,000 gs. Any deposits of new sludge that form in this step are separated from the oil by decanting the supernatant oil and then carefully washing the sludge deposits with 25 ml. of pentane to remove all remaining oil from the sludge. Then the weight of the new solid sludge that has been formed in the test, in milligrams, is determined by drying the residue and weighing it. The results are reported as % of sludge dispersed by comparison with a blank not containing any additional additive. The less new sludge formed, the larger the value of percent sludge dispersed, and the more effective is the additive as a sludge dispersant. In other words, if the additive is effective, it will hold at least a portion of the new sludge that forms on heating and oxidation stably suspended in the oil so it does not precipitate down during the centrifuging. Using the above-described test, the dispersant action of the several functionalized polymers prepared in accordance with this invention were compared with the dispersing power of a dialyzed product obtained from dialysis of a commercial dispersant previously referred to as Lz3702. Sufficient dialyzed residue which analyzed about 0.4 wt. % nitrogen, was dissolved in S-150N mineral oil to provide a 10% active ingredient concentrate. The dialyzed residue and polymer products of the invention were appropriately diluted in mineral oil to furnish the 0.025, 0.05 and 0.1 wt. % of added additive to the used oil. The test results are given in Table I.

TABLE I

| Anionic-graft Polymer of Example No. | Concentration gms. Polymer/10 gr. Used Oil | Percent Sludge Dispersed |
|---|---|---|
| 1 | .1 | 71.6 |
| | .05 | 48.5 |
| 2 | .1 | 81.8 |
| | .05 | 41.7 |
| 3 | .1 | 63.6 |
| | .05 | 52.9 |
| 4 | 0.1 | 88.1 |
| | 0.052 | 82.3 |
| | 0.042 | 80.0 |
| | 0.031 | 53.5 |
| | 0.024 | 12.0 |
| 5 | 0.1 | 89.3 |
| | 0.052 | 83.1 |
| | 0.042 | 83.0 |
| | 0.031 | 63.8 |
| | 0.024 | 11.5 |
| 6 | 0.1 | 42.5 |
| | 0.05 | 50.5 |
| 7 | 0.1 | 71.6 |
| | 0.05 | 14.0 |
| Lz 3702 (Commercial dispersant) | 0.1 | 88.7 |
| | 0.05 | 73.3 |
| | 0.025 | 30.5 |

The results of Table I can be summarized as showing the nitrogen-containing anionic-graft polymers of the invention to have comparable or superior dispersancy in lubricating oils at 0.5 and 1 wt. % additive levels over that shown by a commercially available multifunctional V.I. improver (compare Examples 4 and 5 with Kz3702).

EXAMPLE 9

The nitrogen-containing anionic-graft polymers prepared in Examples 1, 2 and 3 were each tested as a viscosity index improver in ENJ 102, a blended mineral lube oil containing 0.5 wt. % of a polymeric pour depressant. The blend was of two paraffinic, solvent refined neutral oils, one of which had a viscosity of about 150 SUS at 38° C. and constituted 25.75 weight percent of the blend; and, the other had a viscosity of about 300 SUS at 38° C. and constituted 73.75 weight percent of the blend. The comparative results of the three anionic-graft polymer modified ENJ 102 samples (Example 9-1, 9-2 and 9-3) and the ENJ 102 (Example 9-A) are summarized in Table II.

TABLE II

| Example | K.V. (cs) at 99° C. | Vis. (P) at −18° C. | Pour Point ° C. |
|---|---|---|---|
| 9-1* | 12.4 | 25.7 | −40 |
| 9-2* | 12.33 | 25.6 | −40 |
| 9-3* | 12.37 | 26.3 | −37 |
| 9-A | 6.26 | 19.2 | −37 |

*Each test sample was blended with the respective polymer, e.g. 9-1 was blended with the polymer of Example 1, to a 99° C. K. V. (cs) of about 12.4.

The data of Table II shows that polymers of this invention have V.I. improving characteristics while exhibiting no detrimental loss in pour point depression and suitable low temperature viscometrics.

The invention in its broader aspect is not limited to the specific details shown and described and departures may be made from such details without deparating from the principles of the invention and without sacrificing its chief advantages.

What is claimed is:

1. An oil soluble anionic-graft polymer having a number average molecular weight in the range of about 1,000 to 500,000 while containing in the range of about 0.005 to 2 wt. % nitrogen and being useful as an oil additive having dispersancy properties, said oil soluble polymer being a graft polymer of:

1. an anionically polymerizable monomer containing in the range of about 3 to 50 carbon atoms and at least one electron withdrawing group in such proximity to an olefinic bond that said bond is activated, said monomer being selected from the group consisting of:

a. N,N (di $C_{1-10}$ hydrocarbyl) carbodiimides;

b. monomers of the formula:

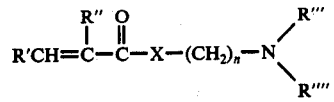

wherein X is oxygen or an NR″ group; $n$ is 2 to 5; R′ and R″ are hydrogen or a $C_1$ to $C_4$ alkyl group; and R‴ and R⁗ are $C_1$ to $C_{12}$ hydrocarbyl groups; and c. nitrile monomers of the formulae:

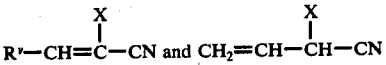

wherein $R^v$ is hydrogen or lower alkyl and X is selected from the group consisting of hydrogen, halogen, cyano and lower alkyl;

and, (2) an anion of an oxidized ethylene copolymer comprising about 20 to 80 mole % ethylene and about 20 to 80 mole % propylene.

2. An oil soluble graft polymer according to claim 12, wherein said monomer is said N,N (di $C_{1-10}$ hydrocarbyl) carbodiimide.

3. An oil soluble graft polymer according to claim 2, wherein said monomer is N,N-diisopropylcarbodiimide.

4. An oil soluble graft polymer according to claim 1, wherein said monomer is said monomer (b).

5. An oil soluble graft polymer according to claim 4, wherein said monomer is N,N-dimethylaminoethyl methacrylate.

6. An oil soluble graft polymer according to claim 1, wherein said monomer is said nitrile monomer (c).

7. An oil soluble graft polymer according to claim 6, wherein said monomer is acrylonitrile.

8. An oil soluble graft polymer according to claim 1, wherein said molecular weight is in the range of 10,000 to 200,000; and said ethylene copolymer contains up to 20 mole % based on the molar amount of ethylene and propylene units, of olefin selected from the group consisting of olefins of the formula $RCH = CH_2$, where R is an aliphatic or cycloaliphatic radical of 2 to 48 carbons and diolefins of 4 to 26 carbon atoms.

9. A lubricating oil composition comprising a major amount of mineral lubricating oil and about 0.1 to 10 wt. % of an oil soluble anionic-graft polymer having a number average molecular weight in the range of about 1,000 to 500,000 while containing in the range of about 0.005 to 2 wt. % nitrogen and being useful as an oil additive having dispersancy properties, said oil soluble polymer being a graft polymer of:

1. an anionically polymerizable monomer containing in the range of about 3 to 50 carbon atoms and at least one electron withdrawing group in such proximity to an olefinic bond that said bond is activated, said monomer being selected from the group consisting of:

a. N,N (di $C_{1-10}$ hydrocarbyl) carbodiimides;

b. monomers of the formula:

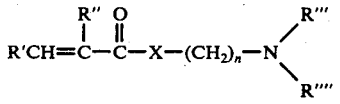

wherein X is oxygen or an NR″ group; *n* is 2 to 5; R′ and R″ are hydrogen or a $C_1$ to $C_4$ alkyl group; and R‴ and R⁗ are $C_1$ to $C_{12}$ hydrocarbyl groups; and c. nitrile monomers of the formulae:

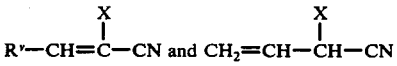

wherein $R^{\nu}$ is hydrogen or lower alkyl and X is selected from the group consisting of hydrogen, halogen, cyano and lower alkyl;

and, (2) an anion of an oxidized ethylene copolymer comprising about 20 to 80 mole % ethylene and about 20 to 80 mol % propylene.

10. A lubricating oil composition according to claim 9, wherein said monomer is said N,N (di $C_{1-10}$ hydrocarbyl) carbodiimide.

11. A lubricating oil composition according to claim 10, wherein said monomer is N,N-diisopropylcarbodiimide.

12. A lubricating oil composition according to claim 9, wherein said monomer is said monomer (b).

13. A lubricating oil composition according to claim 12, wherein said monomer is N,N-dimethylaminoethyl methacrylate.

14. A lubricating oil composition according to claim 9, wherein said monomer is said nitrile monomer (c).

15. A lubricating oil composition according to claim 14, wherein said monomer is acrylonitrile.

16. A lubricating oil composition according to claim 9, wherein said molecular weight is in the range of 10,000 to 200,000; and said ethylene copolymer contains up to 20 mole %, based on the molar amount of ethylene and propylene units, of olefin selected from the group consisting of olefins of the formula $RCH = CH_2$, where R is an aliphatic or cycloaliphatic radical of 2 to 48 carbons and diolefins of 4 to 26 carbon atoms.

17. A process of preparing an anionic-graft polymer comprising the steps of:

1. contacting an oxidized ethylene copolymer comprising about 20 to 80 mole % ethylene and about 20 to 80 mole % propylene, having an oxygen content of from about 0.005 to 6% based on the weight of said copolymer, with an alkyllithium compound of from 3 to 10 carbons under anhydrous conditions and inert atmosphere for a period of between 1 and 25 hours and at a temperature between about 20° C. and 100° C., whereby an anion of said oxidized ethylene copolymer is produced; and 2. contacting said anion with an anionically polymerizable monomer at a temperature between about 0° C. and about 100° C. and for a period of between about 0.2 and 15 hours in the presence of a base whereby an anionic-graft polymer is produced, and wherein said anionically polymerizable monomer is selected from the group consisting of:

a. N,N (di $C_{1-10}$ hydrocarbyl) carbodiimides;

b. monomers of the formula:

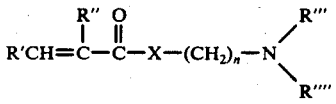

wherein X is oxygen or an NR″ group; n is 2 to 5; R′ and R″ are hydrogen or a $C_1$ to $C_4$ alkyl group; and R‴ and R⁗ are $C_1$ to $C_{12}$ hydrocarbyl groups; and c. nitrile monomers of the formulae:

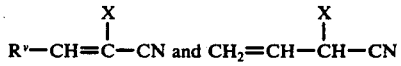

wherein $R^{\nu}$ is hydrogen or lower alkyl and X is selected from the group consisting of hydrogen, halogen, cyano and lower alkyl.

18. A process according to claim 17, wherein said monomer is said N,N (di $C_{1-10}$ hydrocarbyl) carbodiimide.

19. A process according to claim 18, wherein said monomer is N,N-diisopropylcarbodiimide.

20. A process according to claim 17, wherein said monomer is said monomer (b).

21. A process according to claim 20, wherein said monomer is N,N-dimethylaminoethyl methacrylate.

22. A process according to claim 17, wherein said monomer is said nitrile monomer (c).

23. A process according to claim 22, wherein said monomer is acrylonitrile.

24. A process according to claim 17, wherein said molecular weight is in the range of 10,000 to 200,000 and said ethylene copolymer contains up to 20 mole %, based on the molar amount of ethylene and propylene units, of olefin selected from the group consisting of olefins of the formula $RCH = CH_2$, where R is an aliphatic or cycloaliphatic radical of 2 to 48 carbons and diolefins of 4 to 26 carbon atoms.

* * * * *